United States Patent [19]

Smart

[11] Patent Number: 4,825,475

[45] Date of Patent: May 2, 1989

[54] PANTLEG RESTRAINING BAND

[76] Inventor: Keith M. Smart, 3145 Carlsbad Blvd., Carlsbad, Calif. 92008

[21] Appl. No.: 110,669

[22] Filed: Oct. 20, 1987

[51] Int. Cl.[4] ..... A41F 9/00

[52] U.S. Cl. ..... 2/312; 2/DIG. 6

[58] Field of Search ..... 2/DIG. 6, 46, 257, 256, 2/312, 231, 232

[56] References Cited

U.S. PATENT DOCUMENTS

| | | | |
|---|---|---|---|
| 2,386,708 | 10/1945 | Morrison | 2/312 |
| 2,480,276 | 8/1949 | Wilkenfeld | 2/232 |
| 2,525,756 | 10/1950 | Aines | 2/232 |
| 2,860,081 | 11/1958 | Eiken | 2/232 X |
| 2,869,138 | 1/1959 | Hankoff | 2/232 X |
| 3,086,529 | 4/1963 | Munz et al. | 2/DIG. 6 |
| 3,137,863 | 6/1964 | Dimpfl | 2/232 |
| 4,028,741 | 6/1977 | Henry | 2/232 |
| 4,602,389 | 7/1986 | Brown | 2/232 |
| 4,698,852 | 10/1987 | Romero | 2/DIG. 11 |

FOREIGN PATENT DOCUMENTS

| | | | |
|---|---|---|---|
| 2622573 | 12/1977 | Fed. Rep. of Germany | 2/231 |
| 1394253 | 2/1965 | France | 2/232 |
| 2132072 | 7/1984 | United Kingdom | 2/231 |

*Primary Examiner*—Ronald Feldbaum

*Attorney, Agent, or Firm*—Ralph S. Branscomb

[57] ABSTRACT

A pantleg restraining band is provided which is somewhat like a removable cuff for the lower end of the pantleg. The unit will ordinarily come in pairs, and comprises a band, which may be elastic, and which defines spaced, inverted pockets which receive plastic clips to clip onto the pantleg. The band has hook-and-loop fastener material so that it can be wrapped around the bottom of the pantleg and engaged on itself to peg the pants.

4 Claims, 1 Drawing Sheet

PANTLEG RESTRAINING BAND

BACKGROUND OF THE INVENTION

Clothing styles change over the years. Styles that were fashionable become unfashionable, and then often become fashionable again. In the late fifties for example, pants with tightly pegged legs, pegged so tightly that it was difficult to push one's foot through the pantleg, were in style. Shortly thereafter, bell-bottomed trousers were in style, which had just the opposite, wide, floppy legs.

Now, at least on the West Coast, the pegged look is making a comeback. Young people ar pegging their pants with any means possible, such as straight pins, safety, pins, cords and rubber bands.

However, there is clearly a need for a simple, easily usable and inexpensive device for quickly pegging one's pants, and which can be removed from the pants then used on a different pair.

SUMMARY OF THE INVENTION

The instant invention fulfills the above-stated need by providing a flexible, cloth band, which may or may not be elasticized, which is fitted with hook-and-loop fasteners so that it fastens back on itself and can be quickly wrapped around a pantleg of the user.

In the preferred embodiment, on the inside of the band there are a plurality of downwardly open pockets which receive resilient clips which would ordinarily be plastic and which are inserted into the pockets, and engage over the bottom edge of the pant. The clips are out of sight, and the bands are fashionable and stylish, so that in addition to pegging the pants, they act as a fashion accessory.

DETAILED DESCRIPTION OF THE PREFERRED EMBODIMENTS

Figure 1:
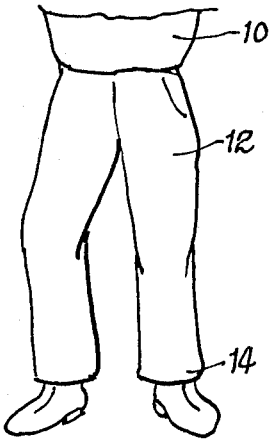
FIG. 1 illustrates a pair of pants with un-pegged legs.
Figure 2:
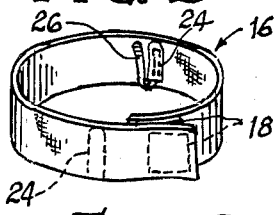
FIG. 2 illustrates the pegging or restraining band as it appears encircled and engaged on itself.
Figure 3:
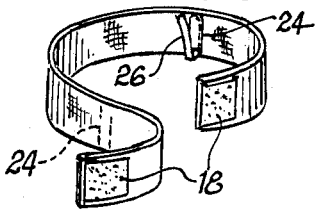
FIG. 3 illustrates the band of FIG. 2 but opened up.
Figure 4:
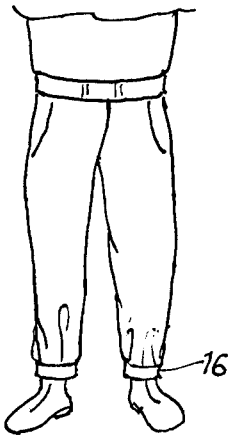
FIG. 4 illustrates a user having a band on each pantleg.
Figure 5:
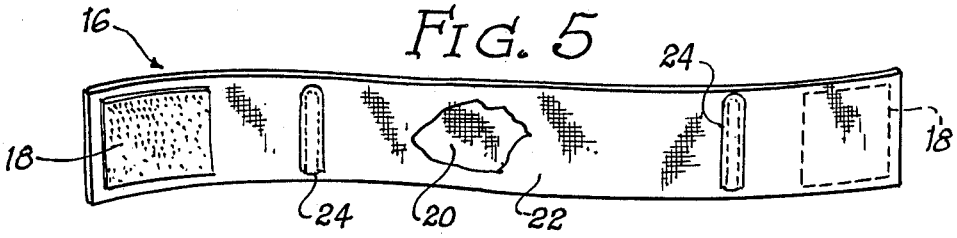
FIG. 5 is an inside view of the band extended.
Figure 6:
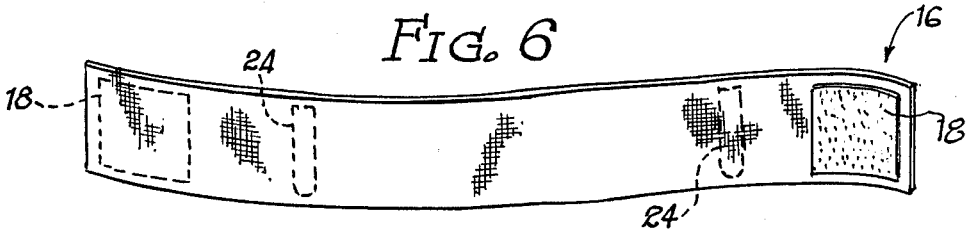
FIG. 6 is the band of FIG. 5 but flipped over to illustrate the other side.
Figure 7:
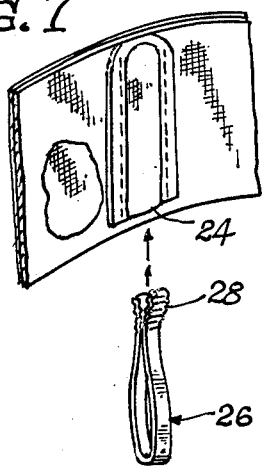
FIG. 7 is a detail of a pocket showing the removable clip.

A gentleman 10 is shown in FIG. 1 in a pair of conventional pants 12 having lower ends 14, which ordinarily would not be cuffed, but may have cuffs. In order to change the look illustrated in FIG. 1 to the look illustrated in FIG. 4 wherein the pegging or restraining band 16 are used, the user would wrap one of the bands around each leg, engaging it on itself by means of the mating hook-and-loop (Velcro) fasteners 18.

The band itself may be made of any kind of fabric, and may have a core of material 20 with a liner or outside material 22, the former being for strength and possibly being elasticized if an elastic embodiment is used, with the latter being for style and appearance, as well as providing some strength.

The band also has inverted pockets 24, there being two in the illustrations but it, of course, being possible to utilize three or even more of the pockets if desired. The pockets are defined on the inside of the band 16 proper. The outside, is supposed to be stylish and have a finished appearance.

Figure 8:
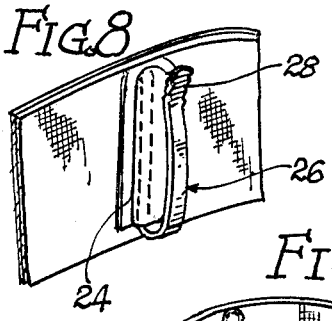
FIG. 8 is a perspective detail showing the clip in place in a pocket.

Inside these pockets 24, a series of removable clips 26, possibly having corrugated tips 28 as shown in FIG. 17, are used to engage both the pocket itself, and the bottom portion of the pantleg. The clip is shown in position in FIG. 8.

Figure 9:
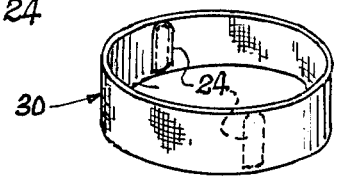
FIG. 9 is a modification in which the band is a continuous elastic garter-type device.

FIG. 9 illustrates a garter-type band 30 embodiment, which is of necessity elastic because it must pass over the foot. It also has the pockets 24 for the removable clips.

In any of the embodiments, the exterior of the band would be not only finished, but also stylish and add some accent to the dress of the user, and could be coordinated with a belt, shirt, or other clothing accessories of the user as well.

I claim:

1. A restraint for the lower end of a pantleg comprising:

(a) a flexible cloth band having means to encircle the leg of a user near the ankle and having means to connect the band to itself to form a loop around the leg, said means to connect the band to itself comprising hook-and-loop fastener material; and (b) pant engaging means for engaging the lower end of a pantleg, said pantleg engaging means comprising a plurality of clips for slipping over a distal end of a pantleg and over a portion of said band, (c) wherein said band defines pockets, downwardly directed in use, to seat said clips to engage said part let.

2. Structure according to claim 1 wherein said clips are removable from said band.

3. Structure according to claim 1 wherein said clips are plasticized metal.

4. Structure according to claim 1 wherein said band incorporates a length of elastic to make it stretchable throughout substantially the entire length.

* * * * *